US006859951B1

(12) United States Patent
Spreitzer

(10) Patent No.: US 6,859,951 B1
(45) Date of Patent: Mar. 1, 2005

(54) TOILET ACCESSORY CONCEALMENT AND TOILET BOWL EVACUATION APPARATUS

(76) Inventor: Eleanor French Spreitzer, 4205 Clairmont Rd., Columbus, OH (US) 43220

( * ) Notice: Subject to any disclaimer, the term of this patent is extended or adjusted under 35 U.S.C. 154(b) by 4 days.

(21) Appl. No.: 10/657,965

(22) Filed: Sep. 9, 2003

(51) Int. Cl.[7] ..... E03D 11/18; A47K 11/10

(52) U.S. Cl. ..... 4/421; 4/300; 4/661; 206/225; 206/361; 206/457; 206/459.5; 206/581; 206/823

(58) Field of Search ..... 4/661, 425, 421, 4/300; 206/225, 361, 445, 457, 459.5, 499, 501, 514, 581, 823

(56) References Cited

U.S. PATENT DOCUMENTS

| | | | | |
|---|---|---|---|---|
| 1,215,294 | A | 2/1917 | Macdonald | |
| 2,448,603 | A | 9/1948 | Kevin et al. | |
| 2,697,646 | A | 12/1954 | Craig | |
| 3,085,678 | A | 4/1963 | Moore | |
| 3,168,984 | A * | 2/1965 | Corning et al. | 4/661 X |
| 3,429,474 | A | 2/1969 | Cann | |
| 4,008,933 | A | 2/1977 | Wanek | |
| 4,033,650 | A | 7/1977 | Alissandratos | |
| 4,211,750 | A | 7/1980 | Gillespie | |
| 4,918,769 | A * | 4/1990 | Gandini | 4/661 |
| 5,040,679 | A | 8/1991 | Rehmann | |
| 5,381,809 | A * | 1/1995 | Parker, Jr. | 134/113 |
| 5,772,015 | A | 6/1998 | Musiel et al. | |
| 5,971,141 | A | 10/1999 | Shafik | |
| 5,984,100 | A | 11/1999 | Ramsey et al. | |
| 6,050,401 | A | 4/2000 | Michaelson | |
| 6,383,457 | B1 | 5/2002 | Brown | |
| 6,446,792 | B1 | 9/2002 | Kaniaris, Jr. | |
| 6,499,151 | B1 * | 12/2002 | Ollinger | 4/255.02 |
| 6,769,542 | B2 * | 8/2004 | Polito | 206/361 |
| 2002/0100705 | A1 * | 8/2002 | Phillips et al. | 206/361 X |
| 2003/0098044 | A1 * | 5/2003 | Peterson | 134/6 |
| 2003/0178430 | A1 * | 9/2003 | Wentz et al. | 220/505 |
| 2004/0003458 | A1 * | 1/2004 | Nasco | 206/349 X |

* cited by examiner

*Primary Examiner*—Gregory L. Huson
*Assistant Examiner*—Kathleen J. Prunner
(74) *Attorney, Agent, or Firm*—David J. Dawsey; Michael J. Gallagher; Gallagher & Dawsey Co., LPA

(57) ABSTRACT

A toilet accessory concealment and toilet bowl evacuation apparatus designed to conceal common bathroom accessories as well as provide one with limited knowledge of plumbing systems with a safe and effective way to reduce the water level in a water closet bowl, or toilet bowl, to facilitate cleaning. The apparatus includes a water-tight primary compartment, a water-tight secondary compartment, and a cover configured to cooperate with the primary compartment and obscure the view of the inside of the primary compartment. The primary compartment is sized and configured to conveniently house a toilet brush, or other bathroom accessory, and retain a first predetermined quantity of liquid when the brush is not in the compartment. The secondary compartment is sized and configured to conveniently house a roll of toilet paper, or other bathroom accessory, and retain a second predetermined quantity of liquid when the roll of toilet paper is not in the compartment.

20 Claims, 8 Drawing Sheets

TOILET ACCESSORY CONCEALMENT AND TOILET BOWL EVACUATION APPARATUS

TECHNICAL FIELD

The present invention relates to the field of water closet, or toilet, cleaning apparatus, in particular to a toilet accessory concealment and toilet bowl evacuation apparatus designed to conceal common bathroom accessories as well as provide one with limited knowledge of plumbing systems with a safe and effective way to reduce the water level in a toilet bowl to facilitate cleaning.

BACKGROUND OF THE INVENTION

Cleaning the water closet, or toilet, in a home, business or other location can be an unpleasant and difficult task. It is frequently accomplished by placing a cleansing agent into the bowl of a toilet and scrubbing with a specially formed toilet brush to remove undesirable elements and mineral deposits from the bowl. This task is made more difficult by the fact that a modern toilet operates on a siphonic principle that maintains a predetermined water level in the bowl between flushes. This means that a person cleaning must contend with cleaning around a standing water line in order to thoroughly clean the bowl. Unsatisfactory attempts to date include placing the cleaning agent in the water, causing dilution of the cleaner, and then attempting to clean the standing water line, or else attempting to scrub during a flush cycle, which is not only brief in duration but also is draining the cleaning agent from the bowl at the same time the cleaner is attempting to work.

The present invention advances the art by providing convenient means to exploit the manner of operation of the modern flush toilet in order to lower the standing water line in the bowl, which allows thorough cleaning with relatively undiluted cleaner, during a quiescent state of bowl operation, which can then easily be restored to the predetermined water line and normal operation.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

A review of the mechanism of the modern flush toilet helps to explain the operation of the instant invention. Most modern toilets operate on a siphonic principle in which a standing bowl of water is connected by an upwardly directed U-shaped trap, which acts as a siphon tube, to a drain line. When the water in the tank, restrained by a flush valve, is suddenly released into the bowl, the sudden onrush of water is sufficient to fill the siphon tube and begin the siphonic cycle. The water and contents of the bowl are sucked upwards through the trap and down the drain line. When the water in the bowl drains low enough, air is sucked into the drain line, the siphon is broken, and the flush cycle stops. Modern toilets are designed to then continue to fill an additional amount of water, slowly, into the bowl to restore the standing water line in the bowl. The amount of fill water, and the rate in which it enters the bowl, is such that it never completely fills the siphon tube.

If, in contrast to initiating a flush cycle by flushing the tank mechanism, one pours a quantity of water quickly into the bowl, a similar flush cycle occurs. The bowl and siphon tube fill, the siphonic cycle begins, and the water in the bowl is sucked through the trap. When the water drains sufficiently for air to break the siphon, the cycle stops. However, in this instance, there is no additional water entering the bowl from the tank, and the standing water remains at a lower level than that in the normal order of operation of the toilet. This exposes the former water line for easy cleaning, leaves a small amount of water at the bottom of the bowl to mix cleaner, and leaves the bowl in a quiescent state during the cleaning process. When cleaning is complete, a simple flush of the tank mechanism will evacuate the cleaning materials and bowl contents, and restore the water line to the normal predetermined level.

The toilet accessory concealment and toilet bowl evacuation apparatus of the present invention is designed to serve a multitude of functions in the bathroom. It may be used to house bathroom accessories such as a toilet brush and rolls of toilet paper. Additionally, various embodiments may also house a plunger, bars of soap, or additional wash cloths. The apparatus may also be used to vastly improve the ability to clean a toilet bowl. It may be used to rapidly introduce a predetermined volume of liquid into the toilet bowl to start siphonic action in the toilet. This procedure removes a majority of the initial toilet bowl liquid and a majority of the first predetermined volume of liquid that was poured into the bowl. By reducing the quantity of liquid in the toilet bowl one can better clean the interior of the toilet bowl.

The toilet accessory concealment and toilet bowl evacuation apparatus includes a water-tight primary compartment, a water-tight secondary compartment, and a cover configured to cooperate with the primary compartment and obscure the view of the inside of the primary compartment. The primary compartment is sized and configured to conveniently house a toilet brush, or other bathroom accessory, and retain a first predetermined quantity of liquid when the brush is not in the compartment. The secondary compartment is sized and configured to conveniently house a roll of toilet paper, or other bathroom accessory, and retain a second predetermined quantity of liquid when the roll of toilet paper is not in the compartment.

The primary compartment has an interior and an exterior surface, and at least one sidewall. The interior surface has a plurality of indicia reflective of a volume of the predetermined volume of liquid. The at least one sidewall has at least one gripping device to grip and handle the primary compartment. In one particular embodiment the size of the primary compartment is such that it permits the retention of at least 1.66 liters, as this quantity has been determined to provide adequate siphonic action in most toilets. The aforementioned indicia allow a user, after a brief trial and error experimentation, to know and to reproduce the optimal amount of water needed for operation in his or her own fixtures. Generally, the greatest dimension of the primary compartment is less than approximately 18 inches thereby permitting the primary compartment to be filled at a bathtub faucet.

As with the primary compartment, the secondary compartment has an interior and an exterior surface and at least one sidewall. The sidewall has at least one gripping device to grip and handle the secondary compartment. The secondary compartment is sized to releasably retain a roll of toilet paper, or other bathroom accessory, and contain a second predetermined quantity of liquid when the roll of toilet paper is removed. Generally the greatest dimension of secondary compartment is less than approximately 6 inches thereby permitting the secondary compartment to be filled at a lavatory faucet. The secondary compartment permits the apparatus to be equally effective whether utilized in a full bathroom, one having a bathtub or shower, or a half-bath, one only having a toilet and a lavatory. When used in a half-bath, since the primary compartment generally will not fit below a lavatory faucet in a lavatory bowl, the secondary compartment serves as an intermediary reservoir to transfer liquid from the lavatory faucet into the primary compartment. The secondary compartment may also incorporate a roll elevator designed to separate the roll of toilet paper from the secondary compartment interior surface to help ensure that the toilet paper remains dry.

The primary compartment and secondary compartment gripping devices may be handles or may include an ergonomic gripping surface formed in the sidewalls. Additionally, the sidewalls may be formed to include spouts to aid in pouring.

The design of the apparatus is such that the primary compartment and the secondary compartment are to be stored and displayed together, thereby reducing clutter in the bathroom. As such, the primary and secondary compartments may interface with one another in any number of ways. For example, the compartments may simply rest on one another, or they may be formed such that one of the compartments is housed inside the other compartment. Additionally, the interface may be such that the compartments releasably lock together.

As previously mentioned, the cover is configured to cooperate with the primary compartment and obscure the view of the inside of the primary compartment. The cover may include a plurality of ventilation passages to permit air movement through the primary compartment thereby aiding in the drying of the brush and reducing the likelihood of mildew growth. Additionally, the cover may further include a ventilated openable compartment capable of releasably containing a replenishable quantity of air freshener.

The apparatus may further be formed such that the primary compartment, the secondary compartment, and the cover collectively appear as a decorative object. The decorative object may include, but is not limited to, variations representing houses, animals, candles, plants, a barber pole, and toy figurines, just to name a few.

Accordingly, the art has needed a simple and convenient apparatus that may serve multiple uses in the bathroom including providing a method for quickly and easily reducing the amount of liquid in a toilet bowl to facilitate improved cleaning.

BRIEF DESCRIPTION OF THE DRAWINGS

Without limiting the scope of the present invention as claimed below and referring now to the drawings and figures:

Also, in the various figures and drawings, the following reference symbols and letters are used to identify the various elements described herein below in connection with the several figures and illustrations: B, BU, T, TB, TP, TR, W, and WL.

DETAILED DESCRIPTION OF THE INVENTION

The toilet accessory concealment and toilet bowl evacuation apparatus of the instant invention enables a significant advance in the state of the art. The preferred embodiments of the apparatus accomplish this by new and novel arrangements of elements and methods that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
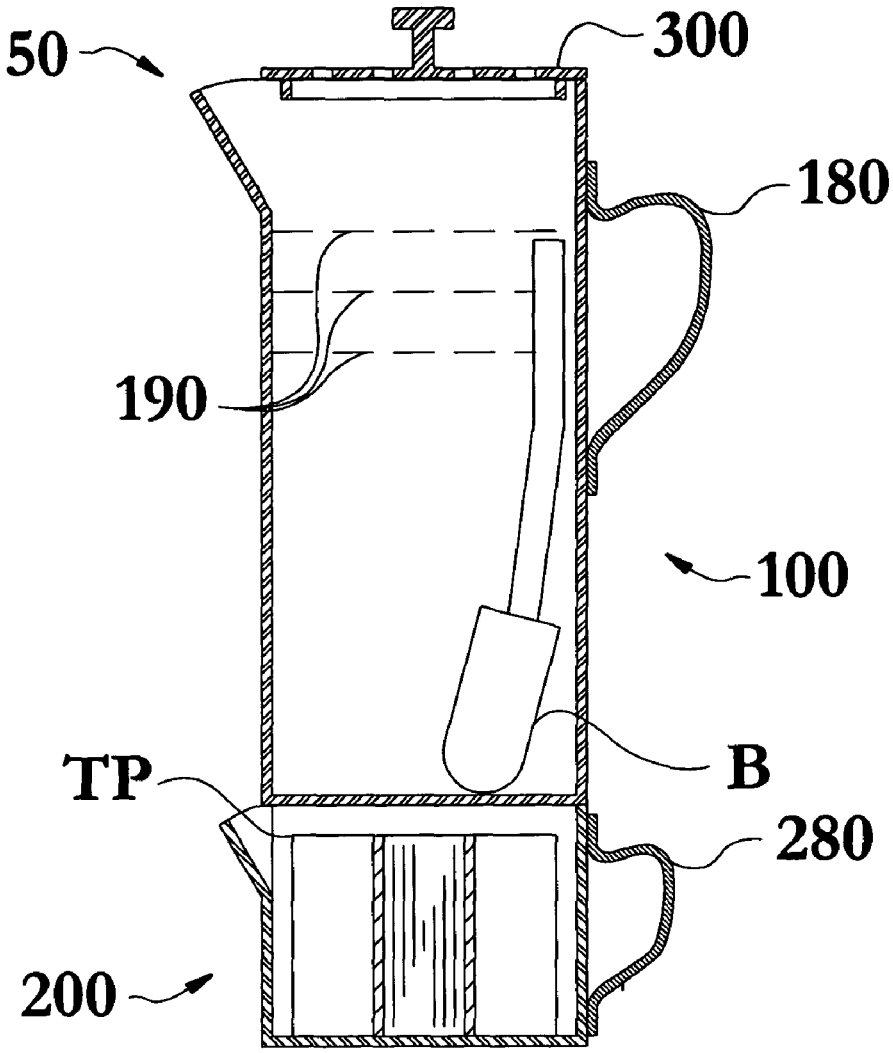
FIG. 1 shows the apparatus of the present invention in cross-section view, not to scale.
Figure 6:
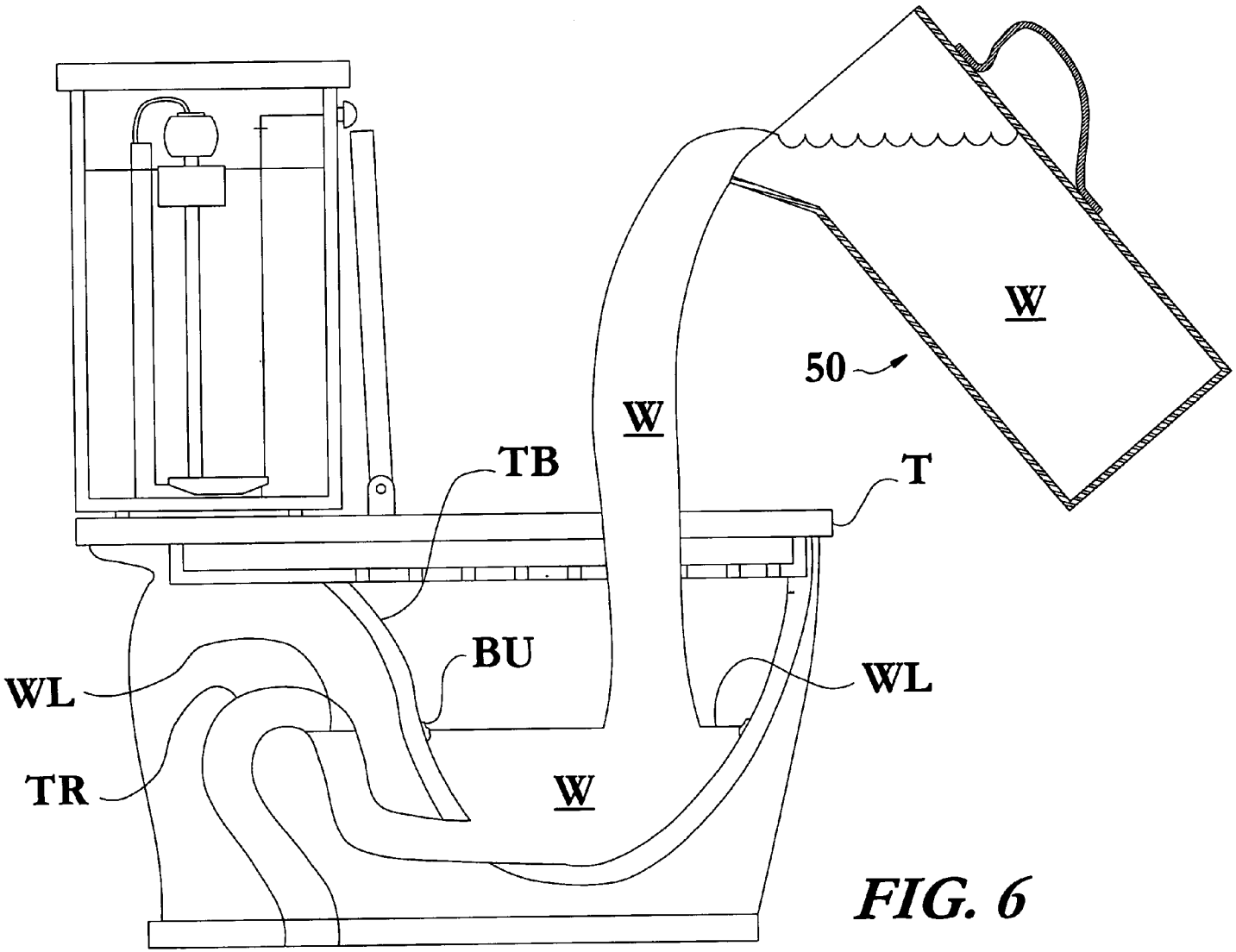
FIG. 6 shows the primary compartment of the present invention in use, not to scale.
Figure 7:
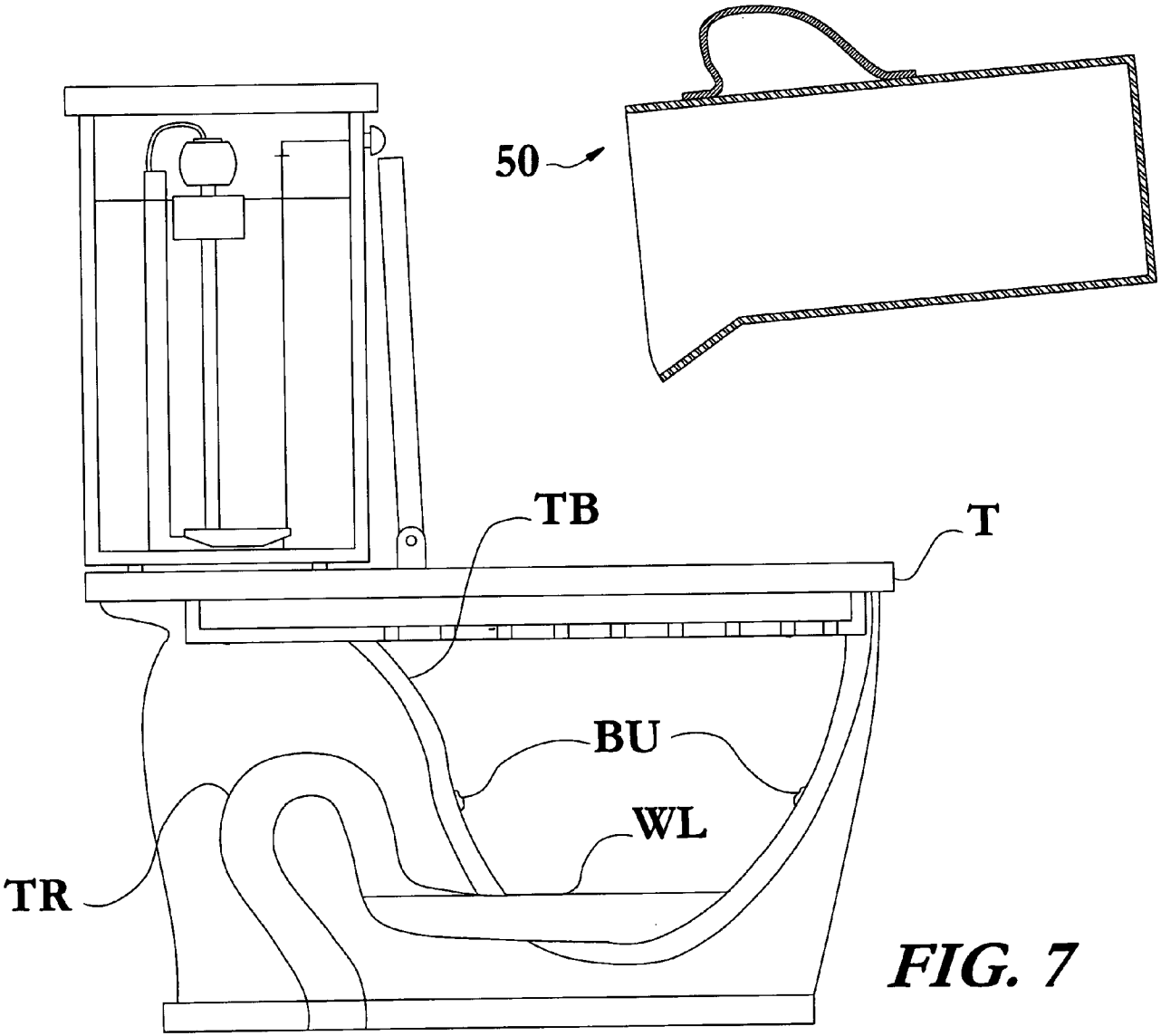
FIG. 7 shows the primary compartment of the present invention in use, not to scale.

The toilet accessory concealment and toilet bowl evacuation apparatus 50 is designed to serve a multitude of functions in the bathroom. It may be used to house at least one toilet brush B, and may further be used to house at least one roll of toilet paper TP, as seen in FIG. 1. The apparatus 50 may additionally be used to rapidly introduce a first predetermined volume of liquid into a toilet bowl TB thereby starting siphonic action in the toilet T and removing a majority of the initial toilet bowl liquid and a majority of the first predetermined quantity of liquid, as seen in FIG. 6 and FIG. 7. By reducing the quantity of liquid in the toilet bowl TB one can better clean the interior of the toilet bowl TB.

Referring again to FIG. 1, in one embodiment the toilet accessory concealment and toilet bowl evacuation apparatus 50 includes a water-tight primary compartment 100, a water-tight secondary compartment 200, and a cover 300 configured to cooperate with the primary compartment 100 and obscure the view of the inside of the primary compartment 100. The primary compartment 100 is sized and configured to conveniently house a toilet brush B and retain the first predetermined quantity of liquid when the brush B is not in the compartment 100. The secondary compartment 200 is sized and configured to conveniently house a roll of toilet paper TP and retain a second predetermined quantity of liquid when the roll of toilet paper TP is not in the compartment 200.

Figure 3:
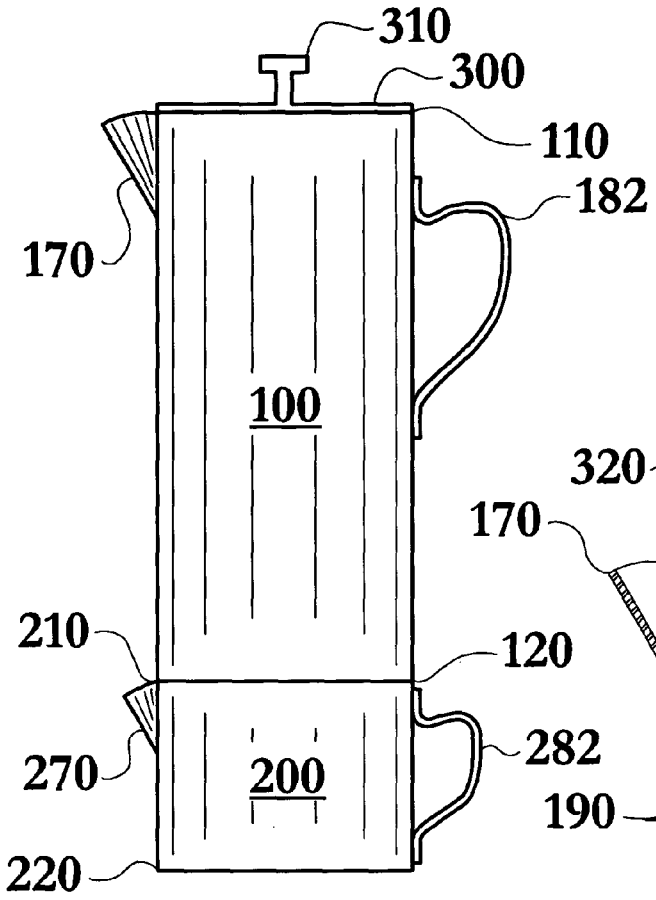
FIG. 3 shows the apparatus of FIG. 1 in side elevation view, not to scale.
Figure 4:
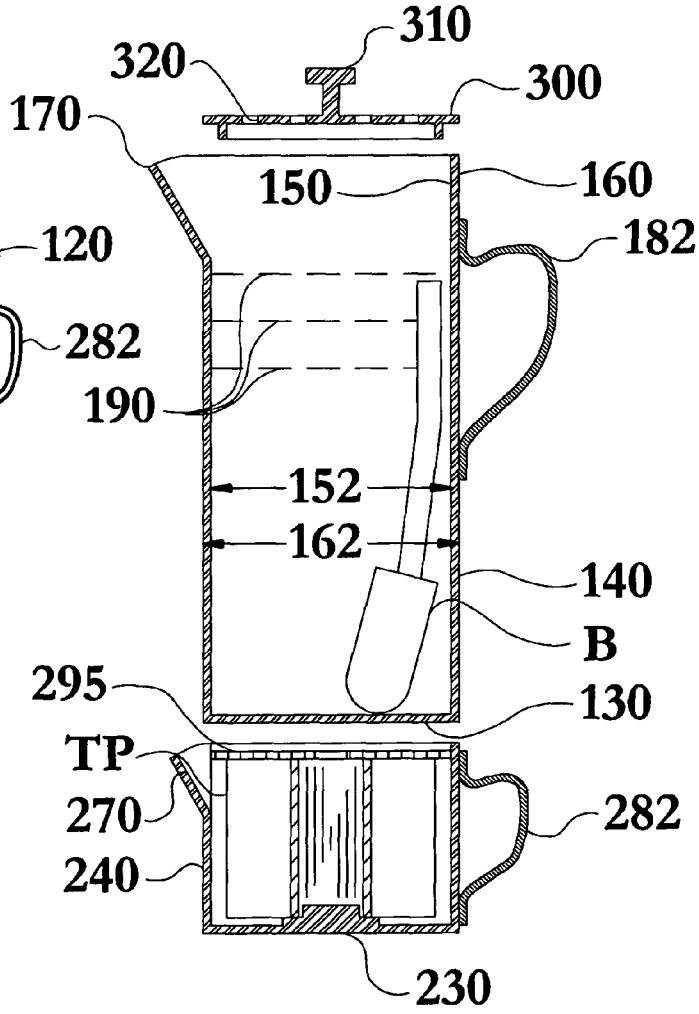
FIG. 4 shows an embodiment of the apparatus of FIG. 1 in cross-section view, not to scale.

The primary compartment 100 has a closed proximal end 120 characterized by a base surface 130 and an open distal end 110, as illustrated in FIG. 3. Referring now to FIG. 4, the primary compartment 100 has an interior and an exterior surface 150, 160, and at least one sidewall 140. The interior surface 150 has a plurality of indicia 190 reflective of a volume of the predetermined volume of liquid. The at least one sidewall 140 has at least one gripping device 180. In one particular embodiment the size of the primary compartment 100 permits the retention of the first predetermined quantity of liquid of at least 1.66 liters, as this quantity has been determined to provide adequate siphonic action in most toilets T. In another embodiment the distance separating the primary compartment distal end 110 and the primary compartment proximal end 120 is less than approximately 18 inches thereby permitting the primary compartment 100 to receive the first predetermined quantity of liquid from a bathtub faucet. In further embodiments, the at least one primary compartment gripping device 180 may be a handle 182, shown in FIG. 4, or may include an ergonomic gripping surface 184, seen in FIG. 8, formed in the at least one primary compartment sidewall 140. The primary compartment gripping device 180 must provide a rigid secure interface between the user and the primary compartment 100, as the primary compartment 100 will be relatively heavy once it contains the first predetermined quantity of liquid. Additionally, the at least one sidewall 140 of the primary compartment 100 may be formed to include a spout 170.

Figure 5:
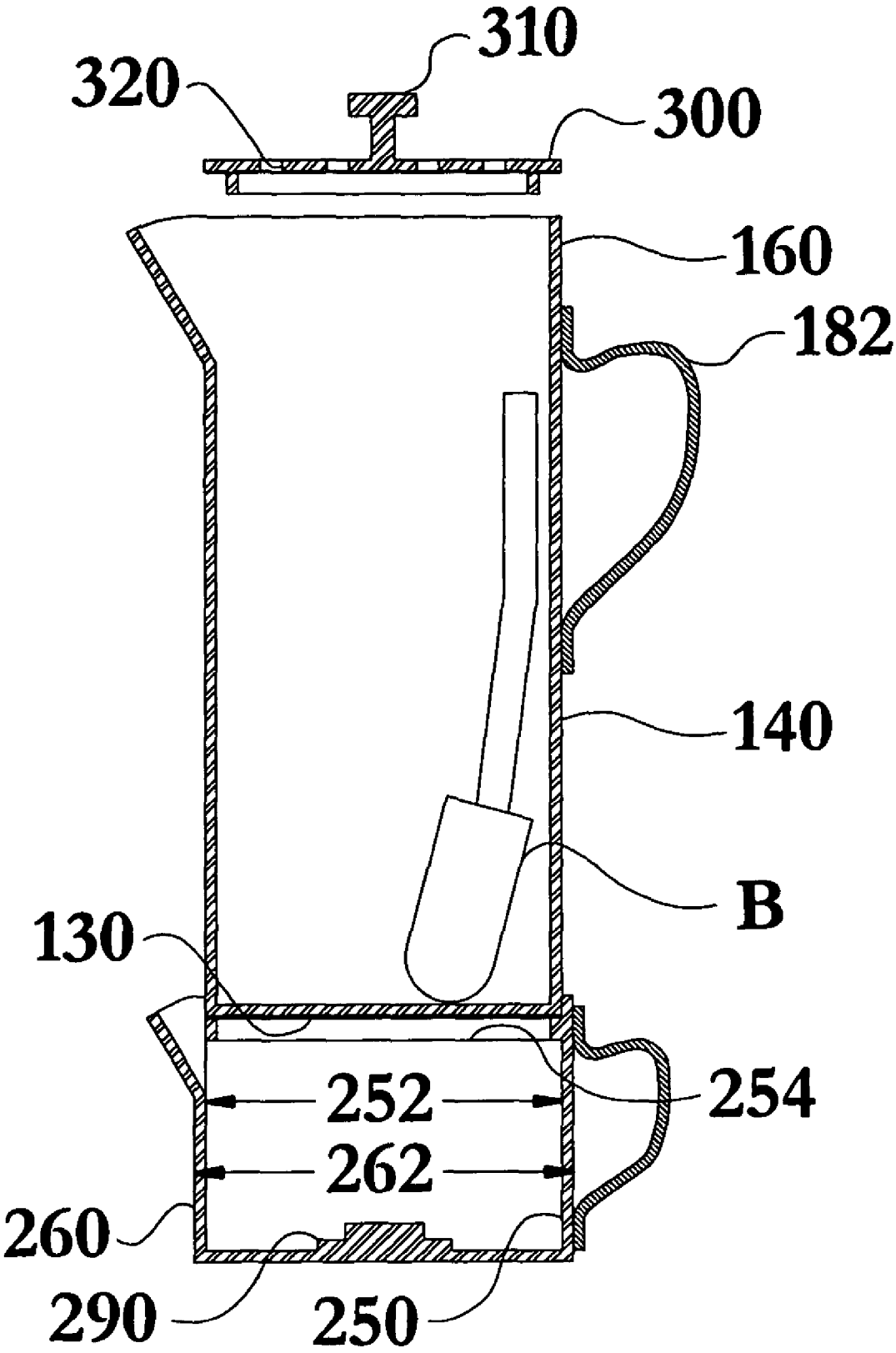
FIG. 5 shows an embodiment of the apparatus of FIG. 1 in cross-section view, not to scale.

Referring again to FIG. 3, the secondary compartment 200 has a closed proximal end 220 characterized by a base surface 230 and an open distal end 210. The secondary compartment 200 has an interior and an exterior surface 250, 260, and at least one sidewall 240, as seen in FIG. 5. The at least one sidewall 240 has at least one gripping device 280, as indicated in FIG. 1. The secondary compartment 200 is sized to releasably retain a roll of toilet paper TP and contain a second predetermined quantity of liquid when the roll of toilet paper TP is removed. The secondary compartment 200 may be sized to releasably accommodate a removable divider 295, seen in FIG. 4, to separate and protect the toilet paper TP or other article stored in the secondary compartment 200. The removable divider 295 may have at least one gripping aperture to facilitate removal of the removable divider 295 from the secondary compartment 200.

In one embodiment, a distance separating the secondary compartment distal end 210 and the secondary compartment proximal end 220 is less than approximately 6 inches thereby permitting the secondary compartment 200 to receive the second predetermined quantity of liquid from a lavatory faucet. The secondary compartment 200 permits the apparatus 50 to be equally effective whether utilized in a full bathroom, one having a bathtub or shower, or a half-bath, one only having a toilet T and a lavatory. When used in a half-bath, since the primary compartment 100 generally will not fit below a lavatory faucet in a lavatory bowl, the secondary compartment 200 serves as an intermediary reservoir to transfer liquid from the lavatory faucet into the primary compartment 100.

Figure 8:
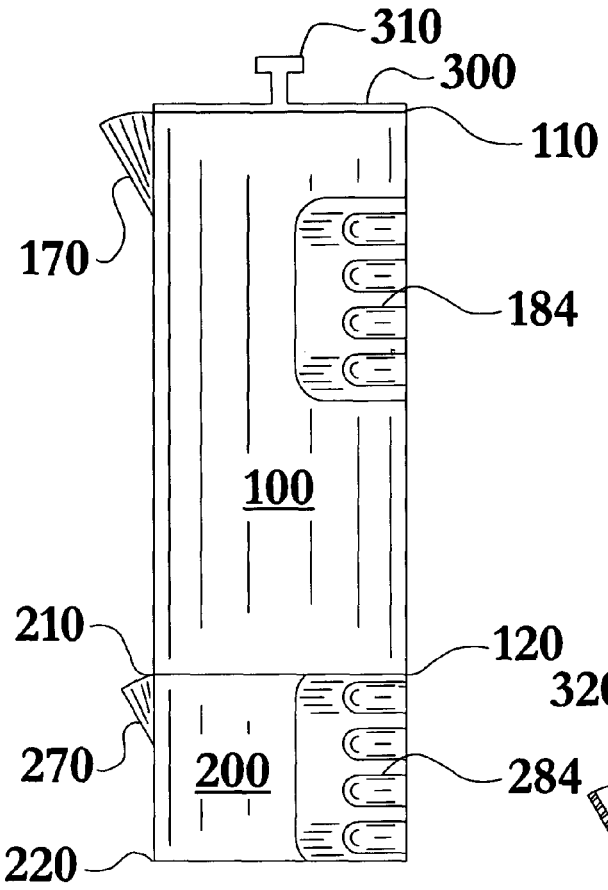
FIG. 8 shows an embodiment of the apparatus of FIG. 1 in side elevation view, not to scale.

In further embodiments, the at least one secondary compartment gripping device 280 may be a handle 282, as seen in FIG. 4, or may include an ergonomic gripping surface 284 formed in the at least one primary compartment sidewall 240, as seen in FIG. 8. Additionally, the at least one sidewall 240 of the secondary compartment 200 may be formed to include a spout 270. In yet another embodiment illustrated in FIG. 5, the secondary compartment 200 may include a roll elevator 290 to separate the roll of toilet paper TP from the secondary compartment interior surface 250.

Figure 9:
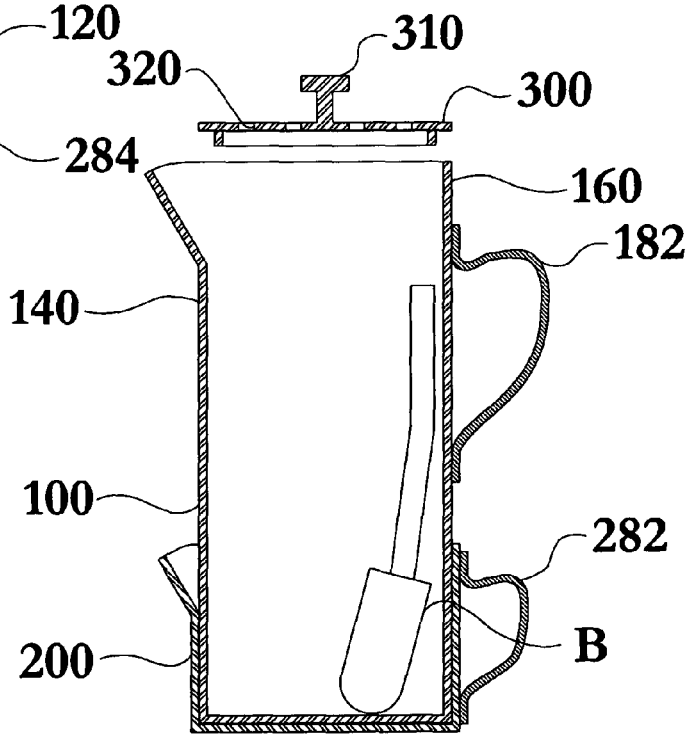
FIG. 9 shows an embodiment of the apparatus of FIG. 1 in cross-section view, not to scale.
Figure 10:
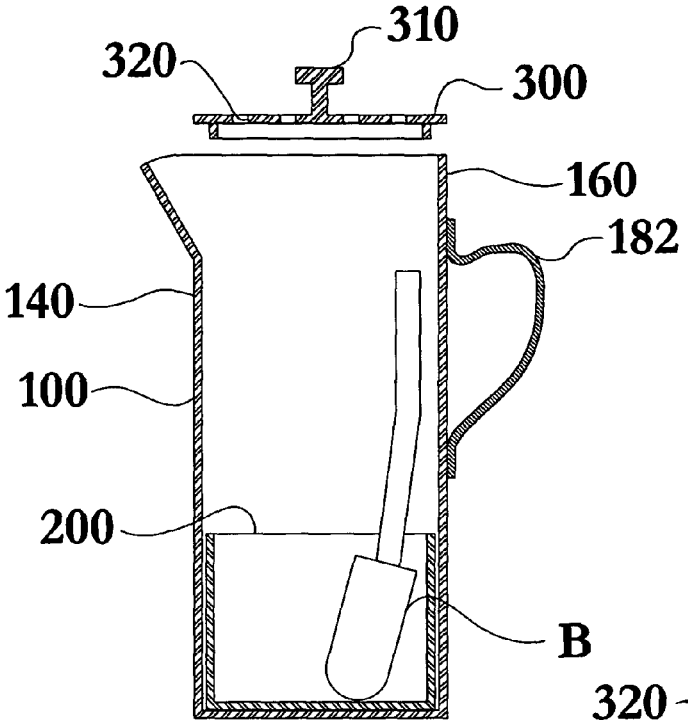
FIG. 10 shows an embodiment of the apparatus of FIG. 1 in cross-section view, not to scale.

The primary compartment 100 and the secondary compartment 200 may interface with one another in any number of ways. For example, in one embodiment, illustrated in FIG. 1, the proximal end 120 of the primary compartment 100 and the distal end 210 of the secondary compartment 200 cooperate so that the primary compartment 100 releasably mounts on the secondary compartment 200. Alternatively, the proximal end 120 of the primary compartment 100 and the distal end 210 of the secondary compartment 200 cooperate so that the primary compartment 100 releasably mounts inside the secondary compartment 200, as seen in FIG. 9. In such an embodiment the secondary compartment interior surface 250 may be formed with at least one ledge 254 upon which the exterior surface 160 of the primary compartment 100 may rest, as illustrated in FIG. 5. Still further, the shape of the primary compartment 100 may cooperate with the secondary compartment 200 such that the secondary compartment 200 may releasably mount in the primary compartment 100, as seen in FIG. 10.

Figure 2:
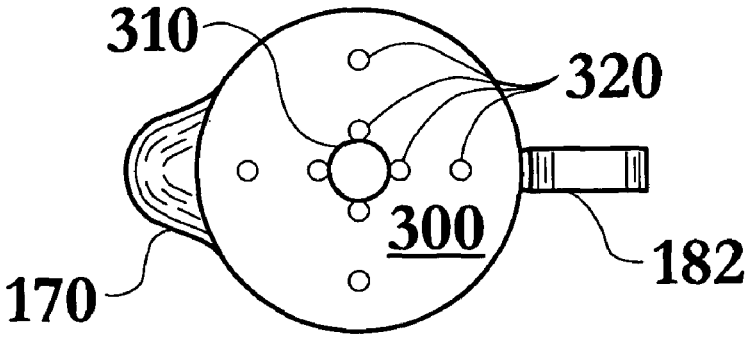
FIG. 2 shows the apparatus of FIG. 1 in top plan view, not to scale.
Figure 11:
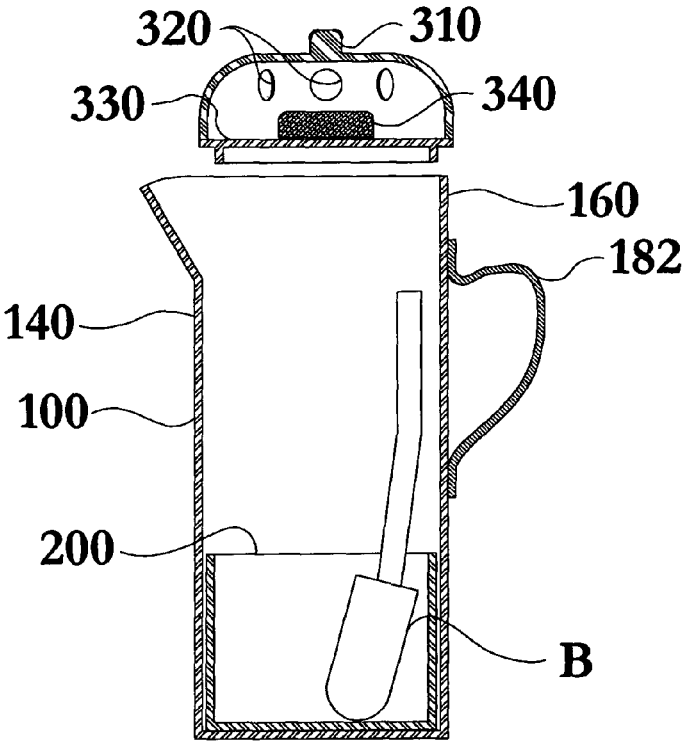
FIG. 11 shows an embodiment of the apparatus of FIG. 1 in cross-section view, not to scale.

The cover 300 is configured to cooperate with the primary compartment 100 and obscure the view of the inside of the primary compartment 100, as seen in FIG. 1. The cover 300 may include a plurality of ventilation passages 320 to permit air movement through the primary compartment 100 thereby aiding in the drying of the brush B and reducing the likelihood of mildew growth, as seen in FIG. 2 and FIG. 4. Additionally, the cover 300 may incorporate a gripping device 310 to aide in the removal and installation of the cover 300. Further, the cover 300 further includes a ventilated openable compartment capable of releasably containing a replenishable predetermined quantity of air freshener, as seen in FIG. 11.

Figure 12:
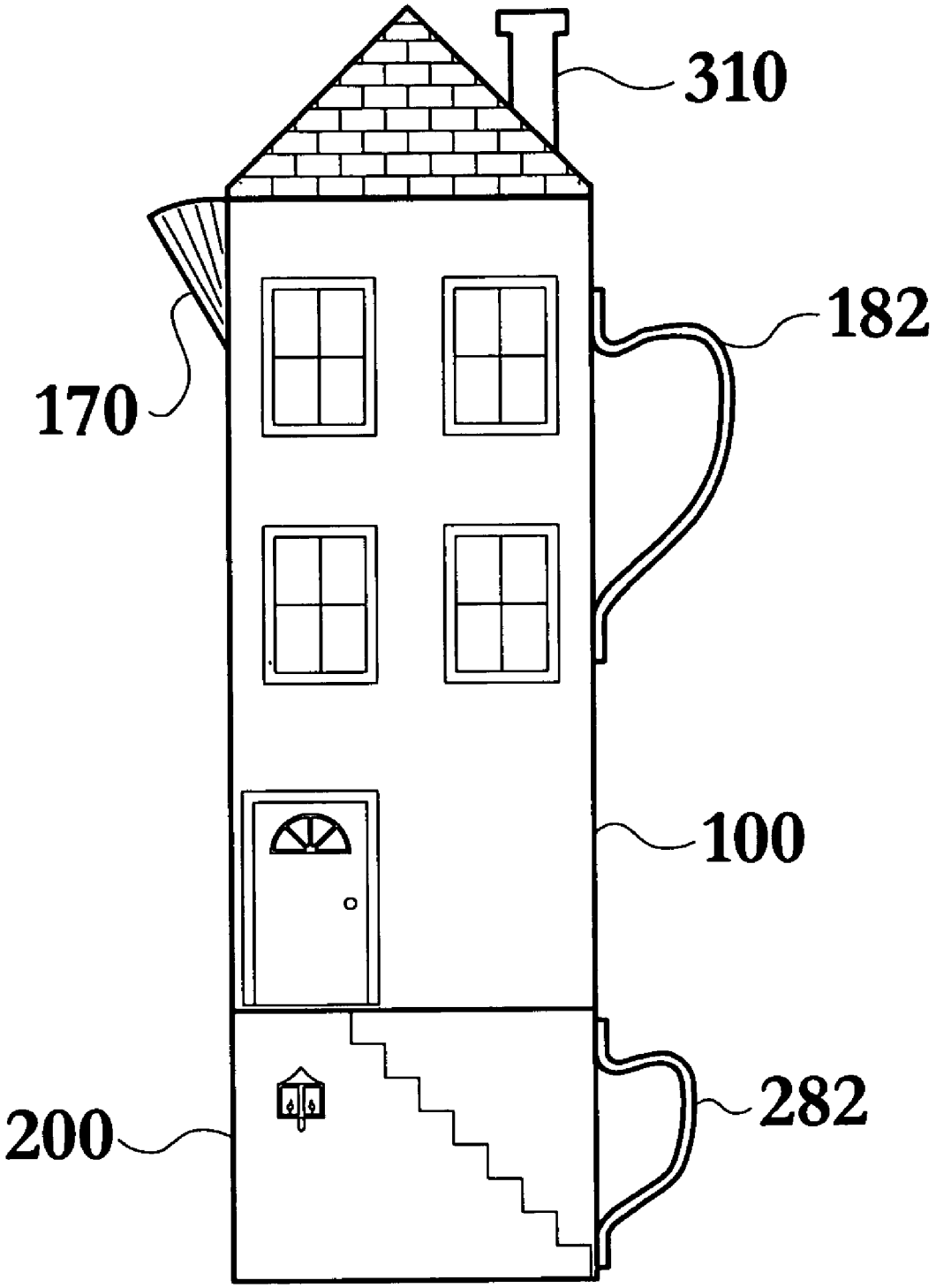
FIG. 12 shows an embodiment of the apparatus of FIG. 1 in side elevation view, not to scale.

The apparatus 50 may further be formed such that the primary compartment 100, the secondary compartment 200, and the cover 300 are formed to collectively appear as a decorative object. For example, the embodiment illustrated in FIG. 12 is formed to appear as a house. The decorative object may include, but is not limited to, variations representing animals, such as dogs and cats, candles, plants, a barber pole, and toy figurines, just to name a few. As one with skill in the art will appreciate, the primary compartment 100, the secondary compartment 200, and the cover 300 may be virtually any shape and profile, therefore the assortment of potential decorative objects and sizes are virtually endless.

Now, with the apparatus 50 described in detail, the method for its use will be addressed. As all adults know, build-up BU of minerals and other impurities occurs in a toilet bowl TB at the interface between the liquid W and the toilet bowl TB. This build-up BU is often difficult to remove in part due to the fact that most cleaning fluids are quickly diluted in the liquid W that remains in the toilet bowl TB during cleaning. The cleaning brush B then merely sloshes around the diluted mixture while attempting to scrape away the build-up BU. The cleaning effectiveness is greatly improved by reducing the amount of liquid in the toilet bowl TB so that the water level WL is significantly below the level of the build-up BU ring.

The reduction in the water level WL is accomplished through the use of the present invention. Further, one is not required to have any knowledge of plumbing systems to effectively use the present invention. The first step in the process is to remove the cover 300 from the primary compartment 100 and remove the brush B. Next, the goal is to fill the primary compartment 100 with water to a desired level, indicated by the plurality of indicia 190 marked in the interior surface 150. The plurality of indicia 190 may consist of a number of lines indicating the level to which the primary compartment 100 must be filled to work effectively with differing toilets. For instance, one of the plurality of indicia 190 lines may represent the level that is effective for the newer low-consumption 1.6 gallon per flush toilet, whereas another may represent the level that is effective for older toilets that consume in excess of 2 gallons per flush. The aforementioned indicia allow a user, after a brief trial and error experimentation, to know and to reproduce the optimal amount of water needed for operation in his or her own fixtures. The primary compartment 100 may be filled either by utilizing a shower or bathtub faucet, or by using the secondary compartment 200 to fill the primary compartment 100. The secondary compartment 200 is primarily used in half-bath bathrooms only having a lavatory faucet as a source of water. In such a situation the secondary compartment 200 is repeatedly filled with water from the lavatory faucet that is then transferred to the primary compartment 100. The new and novel design of the present apparatus 50 makes it equally effective, and convenient, for half-bathrooms and full bathrooms.

Once the primary compartment 100 is filled to the desired level, the user holds the primary compartment 100 by the gripping device 180 over the toilet bowl TB and begins rapidly pouring the contents into the toilet bowl TB, as shown in FIG. 6. The toilet bowl TB and trap TR temporarily rise above their normal water level WL and the siphonic cycle begins. A majority of the water in the toilet bowl TB is sucked through the trap TR. The siphonic cycle ends when the water drains sufficiently for air to break the siphon in the trap TR. As one with skill in the art can appreciate, when using this method no additional water enters the toilet bowl from the toilet tank, as would be the case in a normal flush cycle. Therefore, the new water level WL in the toilet bowl TB is significantly below the level of the build-up BU, as seen in FIG. 7, thereby permitting easy cleaning of the toilet bowl TB. When cleaning is complete, a simple flush of the tank mechanism will evacuate the cleaning materials and bowl contents, and restore the water level to the normal predetermined level.

The material and construction of the components of the apparatus 50 is selected to be an impact resistant and durable material that resists abrasion wear and that can withstand exposure to deleterious fluids and substances, such as, without limitation, biological, and commercial cleaning fluids and substances. Some such exemplary substances and fluids include high temperature water, cleaning and disinfecting fluids, biological fluids, bacteria, and fungi, to name a few. The apparatus 50 may further include an antimicrobial agent, which may form a surface coating on at least the primary compartment interior surface 150 and the secondary compartment interior surface 250, to reduce, or eliminate, the build-up of undesirable elements in the apparatus 50.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A toilet accessory concealment and toilet bowl evacuation apparatus designed to house at least one toilet brush when the apparatus is not in use and when the apparatus is in use it receives a first predetermined quantity of liquid, that when rapidly poured into a toilet bowl containing an initial quantity of liquid, starts siphonic action which thereby removes a majority of the predetermined quantity of liquid and a majority of the initial quantity of liquid such that the toilet bowl may be easily cleaned, comprising:

a primary compartment that is water-tight having a closed proximal end characterized by a base surface, an interior surface, an exterior surface, an open distal end, and at least one sidewall having at least one gripping device, where the primary compartment is sized to retain the first predetermined quantity of liquid, and wherein the interior surface has a plurality of indicia reflective of a volume of the predetermined volume of liquid;

a cover sized to cooperate with the open distal end of the primary compartment and having at least one ventilation passage and at least one gripping device, wherein the cover is configured to obscure the view of the interior surface of the primary compartment; and a secondary compartment that is water-tight having a closed proximal end characterized by a base surface, an interior surface, an exterior surface, an open distal end, and at least one sidewall having at least one gripping device, where the secondary compartment is sized to releasably retain an accessory and contain a second predetermined quantity of liquid when the accessory is removed.

2. The toilet accessory concealment and toilet bowl evacuation apparatus of claim 1, wherein the shape of the primary compartment proximal end cooperates with the secondary compartment distal end such that the primary compartment releasably mounts on the secondary compartment.

3. The toilet accessory concealment and toilet bowl evacuation apparatus of claim 1, wherein the shape of the primary compartment proximal end cooperates with the secondary compartment such that the primary compartment may releasably mount in the secondary compartment.

4. The toilet accessory concealment and toilet bowl evacuation apparatus of claim 1, wherein the shape of the primary compartment cooperates with the secondary compartment such that the secondary compartment may releasably mount in the primary compartment.

5. The toilet accessory concealment and toilet bowl evacuation apparatus of claim 1, wherein the size of the primary compartment permits the retention of the first predetermined quantity of liquid of at least 1.66 liters.

6. The toilet accessory concealment and toilet bowl evacuation apparatus of claim 1, wherein a distance separating the primary compartment distal end and the primary compartment proximal end is less than approximately 18 inches thereby permitting the primary compartment to receive the first predetermined quantity of liquid from a bathtub faucet.

7. The toilet accessory concealment and toilet bowl evacuation apparatus of claim 1, wherein a distance separating the secondary compartment distal end and the secondary compartment proximal end is less than approximately 6 inches thereby permitting the secondary compartment to receive the second predetermined quantity of liquid from a lavatory faucet.

8. The toilet accessory concealment and toilet bowl evacuation apparatus of claim 1, wherein the at least one primary compartment gripping device is a handle.

9. The toilet accessory concealment and toilet bowl evacuation apparatus of claim 1, wherein the at least one primary compartment gripping device is an ergonomic gripping surface formed in the at least one primary compartment sidewall.

10. The toilet accessory concealment and toilet bowl evacuation apparatus of claim 1, wherein the accessory is a roll of toilet paper.

11. The toilet accessory concealment and toilet bowl evacuation apparatus of claim 10 wherein the roll of toilet paper is elevated within the secondary compartment by a roll elevator to separate the roll of toilet paper from the secondary compartment interior surface.

12. The toilet accessory concealment and toilet bowl evacuation apparatus of claim 1, wherein the primary compartment interior surface and the secondary compartment interior surface include an anti-microbial coating.

13. The toilet accessory concealment and toilet bowl evacuation apparatus of claim 1, wherein the cover further includes a ventilated openable compartment capable of releasably containing a replenishable predetermined quantity of air freshener.

14. The toilet accessory concealment and toilet bowl evacuation apparatus of claim 1, wherein the at least one sidewall of the primary compartment is formed to include a spout.

15. The toilet accessory concealment and toilet bowl evacuation apparatus of claim 1, wherein the at least one sidewall of the secondary compartment is formed to include a spout.

16. The toilet accessory concealment and toilet bowl evacuation apparatus of claim 1, wherein the primary compartment, the secondary compartment, and the cover are formed to collectively appear as a decorative object.

17. The toilet accessory concealment and toilet bowl evacuation apparatus of claim 1, wherein the primary compartment interior surface and the secondary compartment interior surface include an anti-microbial coating.

18. The toilet accessory concealment and toilet bowl evacuation apparatus of claim 1, wherein the cover further includes a ventilated openable compartment capable of releasably containing a replenishable predetermined quantity of air freshener.

19. A toilet accessory concealment and toilet bowl evacuation apparatus designed to house at least one toilet brush when the apparatus is not in use and when the apparatus is in use it receives a first predetermined quantity of liquid, that when rapidly poured into a toilet bowl containing an initial quantity of liquid, starts siphonic action which thereby removes a majority of the predetermined quantity of liquid and a majority of the initial quantity of liquid such that the toilet bowl may be easily cleaned, comprising:

a primary compartment that is water-tight having a closed proximal end characterized by a base surface, an interior surface, an exterior surface, an open distal end, wherein a distance separating the primary compartment distal end and the primary compartment proximal end is less than approximately 18 inches thereby permitting the primary compartment to receive the first predetermined quantity of liquid from a bathtub faucet, and at least one sidewall having at least one handle and at least one spout, where the primary compartment is sized to retain the first predetermined quantity of liquid in a quantity of at least 1.66 liters, and wherein the interior surface has a plurality of indicia reflective of a volume of the predetermined volume of liquid;

a cover sized to cooperate with the open distal end of the primary compartment and having at least one ventilation passage and at least one gripping device, wherein the cover is configured to obscure the view of the interior surface of the primary compartment;

a secondary compartment that is water-tight having a closed proximal end characterized by a base surface, an interior surface, an exterior surface, an open distal end, wherein a distance separating the secondary compartment distal end and the secondary compartment proximal end is less than approximately 6 inches thereby permitting the secondary compartment to receive the second predetermined quantity of liquid from a lavatory faucet, and at least one sidewall having at least one handle and at least one spout, where the secondary compartment is sized to releasably retain a roll of toilet paper elevated within the secondary compartment by a roll elevator to separate the roll of toilet paper from the secondary compartment interior surface.

20. A toilet accessory concealment and toilet bowl evacuation apparatus designed to house at least one toilet brush when the apparatus is not in use and when the apparatus is in use it receives a first predetermined quantity of liquid, that when rapidly poured into a toilet bowl containing an initial quantity of liquid, starts siphonic action which thereby removes a majority of the predetermined quantity of liquid and a majority of the initial quantity of liquid such that the toilet bowl may be easily cleaned, comprising:

a primary compartment that is water-tight having a closed proximal end characterized by a base surface, an interior surface having an anti-microbial coating, an exterior surface, an open distal end, wherein a distance separating the primary compartment distal end and the primary compartment proximal end is less than approximately 18 inches thereby permitting the primary compartment to receive the first predetermined quantity of liquid from a bathtub faucet, and at least one sidewall having at least one handle and at least one spout, where the primary compartment is sized to retain the first predetermined quantity of liquid in a quantity of at least 1.66 liters, and wherein the interior surface has a plurality of indicia reflective of a volume of the predetermined volume of liquid;

a cover including a ventilated openable compartment capable of releasably containing a replenishable predetermined quantity of air freshener, the cover sized to cooperate with the open distal end of the primary compartment and having at least one ventilation passage and at least one gripping device, wherein the cover is configured to obscure the view of the interior surface of the primary compartment;

a secondary compartment that is water-tight having a closed proximal end characterized by a base surface, an interior surface having an anti-microbial coating, an exterior surface, an open distal end, wherein a distance separating the secondary compartment distal end and the secondary compartment proximal end is less than approximately 6 inches thereby permitting the secondary compartment to receive the second predetermined quantity of liquid from a lavatory faucet, and at least one sidewall having at least one handle and at least one spout, where the secondary compartment is sized to releasably retain a roll of toilet paper elevated within the secondary compartment by a roll elevator to separate the roll of toilet paper from the secondary compartment interior surface; and wherein the primary compartment, the secondary compartment, and the cover are formed to collectively appear as a decorative object.

* * * * *